US008276714B2

(12) United States Patent
Broyles

(10) Patent No.: US 8,276,714 B2
(45) Date of Patent: Oct. 2, 2012

(54) EMERGENCY EVACUATION RAPPEL LINE ANCHOR MOUNT APPARATUS

(75) Inventor: Sean C. Broyles, Bristol, TN (US)

(73) Assignee: Skedco, Inc., Tualatin, OR (US)

( * ) Notice: Subject to any disclaimer, the term of this patent is extended or adjusted under 35 U.S.C. 154(b) by 0 days.

(21) Appl. No.: 13/152,120

(22) Filed: Jun. 2, 2011

(65) Prior Publication Data

US 2011/0232994 A1 Sep. 29, 2011

Related U.S. Application Data

(63) Continuation of application No. 11/543,437, filed on Oct. 4, 2006, now abandoned.

(60) Provisional application No. 60/723,598, filed on Oct. 4, 2005.

(51) Int. Cl.
*A62B 1/18* (2006.01)
*A47G 29/00* (2006.01)

(52) U.S. Cl. ..... 182/70; 248/925

(58) Field of Classification Search ..... 182/70; 248/925; 294/82.1, 97
See application file for complete search history.

(56) References Cited

U.S. PATENT DOCUMENTS

| | | | | |
|---|---|---|---|---|
| 195,161 | A | 9/1877 | Philbrook | |
| 598,110 | A | 2/1898 | Petersen | |
| 1,258,023 | A * | 3/1918 | Landfried | 43/96 |
| 1,814,037 | A | 7/1931 | Hazen et al. | |
| 2,200,695 | A | 5/1940 | Kaut | |
| 3,948,751 | A | 4/1976 | Bianchi et al. | |
| 4,300,382 | A | 11/1981 | Meek | |
| 4,308,628 | A | 1/1982 | Kunberger et al. | |
| 4,714,135 | A | 12/1987 | Bell et al. | |
| 5,288,265 | A | 2/1994 | Beason et al. | |
| 6,132,305 | A | 10/2000 | Witherell | |
| D448,640 | S | 10/2001 | Petzl | |
| 6,474,441 | B1 | 11/2002 | Bertolino | |
| 6,530,614 | B1 | 3/2003 | Wooten et al. | |
| 6,547,790 | B2 | 4/2003 | Harkey, III et al. | |
| 2005/0073161 | A1 | 4/2005 | Philbin | |
| 2007/0246298 | A1 * | 10/2007 | Botti | 182/3 |

FOREIGN PATENT DOCUMENTS

| | | |
|---|---|---|
| FR | 2572656 | 5/1986 |
| FR | 2572656 A1 * | 5/1986 |

* cited by examiner

*Primary Examiner* — Alvin Chin Shue
(74) *Attorney, Agent, or Firm* — Stoel Rives LLP

(57) ABSTRACT

A rappel line anchor mount apparatus for use primarily with generally planar type support surfaces and fixtures provides a generally flat, substantially T-shaped body arranged to mount a rappel line on the normally upright leg extending substantially perpendicularly centrally from the work surface edge of the normally laterally extending top leg forming the T-shaped anchor body. The anchor mount apparatus may be formed with opposite jaw members pivotally secured together for movement between an extended, operative condition for use, and a collapsed, folded condition for efficient storage and carrying when not in use.

10 Claims, 2 Drawing Sheets

EMERGENCY EVACUATION RAPPEL LINE ANCHOR MOUNT APPARATUS

RELATED APPLICATIONS

This application is a continuation of U.S. patent application Ser. No. 11/543,437 titled "Emergency Evacuation Rappel Line Anchor Mount Apparatus" filed on Oct. 4, 2006, which claims priority under 35 U.S.C. §119(e) to U.S. Patent Application No. 60/723,598 titled "Emergency Evacuation Rappel Line Anchor Mount Apparatus" filed on Oct. 4, 2005, which are both fully incorporated herein by reference.

BACKGROUND

This invention relates to rappelling apparatus and more particularly to a mounting anchor apparatus for securing the upper end of a rappel line to a fixed, elevated support, including walls and other generally planar support surfaces, for facilitated, emergency rappelling evacuation of a personnel from an elevated location.

The present invention provides a rappel line anchor apparatus for providing a quick and secure emergency mount for a rappelling line when urgency or other dangerous conditions require the most expedient escape by rappelling. As an example, if a firefighter or other rescue personnel is trapped on an upper floor of a building with a fire blocking stairway exit and about to break through to the floor occupied by the personnel, immediate rappelling exit from the building is oftentimes the only escape possible, and it is a matter of life and death action. Similarly, in an example of a military situation, if a soldier were trapped on an upper floor with enemy soldiers advancing on him from floors below, a rappelling escape from the building may be his only realistic hope of surviving the situation.

In any such situation as these, among many other different situations as may be imagined, there may not be any fixed structure or fixture available in the area to which the evacuee can safely loop, tie or otherwise attach his rappel line. Indeed, it is likely that a room may only have a window frame on an exterior wall or even a jagged hole through the exterior wall left by previous artillery shelling, etc. This emergency evacuation rappel line anchor apparatus is directed to such circumstances among many other similar mounting situations as may be encountered by persons requiring emergency rappelling exit from elevated locations.

Emergency rappelling systems have been provided in order to address the needs of firefighters, military and other emergency personnel in emergency rappelling situations involving buildings and other structures. One such system is disclosed in U.S. Pat. No. 4,714,135 to Bell, et al. wherein a compact, rapidly-deployable rappel line having a carabeener secured at its upper end is provided in a carrier pouch connected to a harness arrangement worn by a military, fire or other rescue personnel working at elevated positions. This reference teaches the need and benefit of providing such personnel involved in potential rappelling situations with a rappelling arrangement that provides for quickest deployment for rapid, rappelling evacuation.

Aside from this teaching, this reference also illustrates the state of the prior art and the limitations and disadvantages that have been left unresolved with regard to the securement of the upper end of a rappel line to fixed supports available in a building or other elevated structure. In this, Bell, et al. neither provides nor suggests any rappel line anchor mount apparatus for securing the upper end of the rappel line except simply to loop the upper terminal end portion of the rappel line itself about a fixed support structure such as a vent stack on the roof of a building, as shown in FIG. 9 of the patent. This arrangement for securing the upper end of the rappel line is suitable only when there is a suitable fixture available in the area to which the rappel line can be looped around and secured or tied to. On roofs of buildings, such structures typically are vent and chimney stacks, hand and safety railings and other such fixed structures. Inside buildings however, few rigidly fixed, structurally sound fixtures to which a rappel line can be tied or looped about are likely to be readily available near the area of rappelling evacuation such as at a window or hole in an exterior wall of the building. Thus, it is readily apparent that even the possibility of evacuation by the rappel rescue system of the prior art is dependent entirely upon the availability of some form of securely mounted fixture on or within the building to which the upper end of the rappel line of the system may be securely looped about or tied to. Absent such fixture, the rescue system of Bell, et al. is rendered substantially entirely useless.

SUMMARY

In its basic concept, this invention provides an anchor mount apparatus arranged for quick, emergency deployment from a folded, storage condition carried in a pouch worn as standard equipment by firefighters, military and other emergency personnel into an extended, operative, substantially T-shaped condition arranged to engage generally planar support surfaces bordering an opening therethrough for securing the upper end of the rappelling line for emergency rappelling evacuation of an elevated scene by the personnel.

It is by virtue of the foregoing basic concept that the principal objective of this invention is achieved; namely, the provision of a quickly-deployable rappel line anchor mount apparatus that is arranged to permit safe securement of a rappel line to flat and other available generally planar support surfaces of an elevated structure for rapid rappelling evacuation from an area in emergency situations, and thereby expand the range of possible mounting options available to emergency personnel in need of quick and safe rappelling evacuation of buildings and other structures, and thus overcome the disadvantages and limitations of emergency rappelling evacuation apparatus of the prior art.

Another object and advantage of this invention is the provision of an emergency rappel line anchor apparatus of the class described which may be arranged to be pivoted between a collapsed, compact storage and transport condition arranged to be conveniently worn by a person as a part of standard equipment and an extended, operative, locked condition for engaging flat and other generally planar support surfaces for supporting the upper terminal end of a rappel line for use.

Another object and advantage of this invention is the provision of an emergency rappel line anchor apparatus of the class described which may be provided for frictional, biting engagement with a generally planar support surface for assuring positive operative and safe securement of the apparatus during use.

Yet another object and advantage of this invention is the provision of an emergency rappel line anchor apparatus of the class described utilizing a pair of substantially identical jaw members pivotally secured together, one jaw member in inverted condition relative to the other, whereby to simplify manufacturing complexities.

A further object and advantage of this invention is the provision of an emergency rappel line anchor apparatus of the class described which is arranged to be releasably locked in operative condition and secure a rappel line by engagement of a standard carabeener or other suitable connector ring structure.

A further object and advantage of this invention is the provision of an emergency rappel line anchor apparatus of the class described which avoids the necessity of a physical structure to which the rappel line itself must be directly tied or physically looped around and secured, and the associated time-consuming operations that may be involved therewith.

A still further object and advantage of this invention is the provision of an emergency rappel line anchor apparatus of the class described which is of simplified construction for economical manufacture and reliability in operation.

The foregoing and other objects and advantages of this invention will appear from the following detailed description, taken in connection with the accompanying drawings of a preferred embodiment.

DETAILED DESCRIPTION OF PREFERRED EMBODIMENTS

Figure 1:
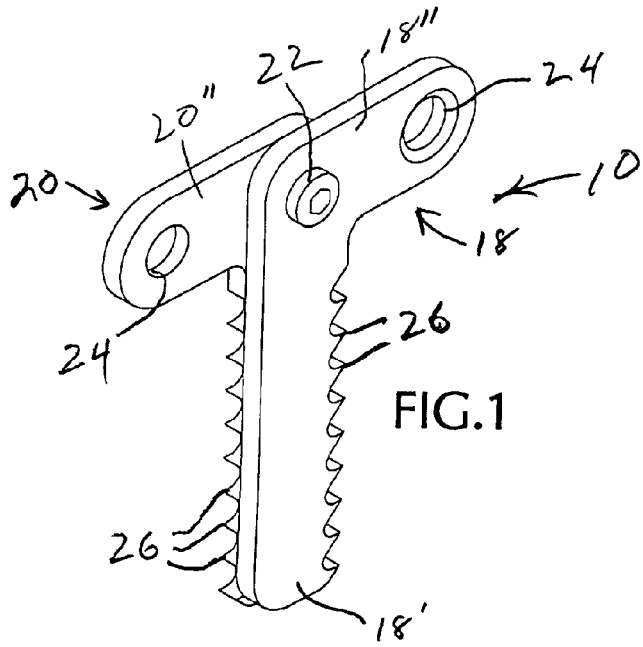
FIG. 1 is a front perspective view showing an apparatus embodying features of the invention in a folded, storage, inoperative condition.
Figure 3:
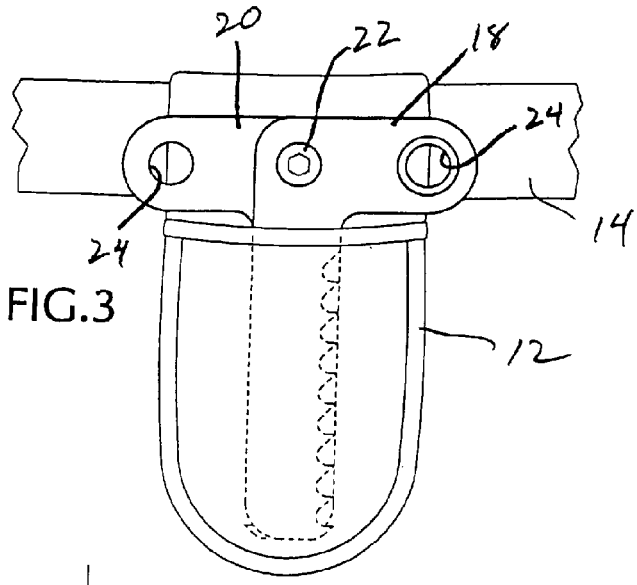
FIG. 3 is a fragmentary front elevation of the apparatus of FIG. 1 contained within a storage carrier pouch secured on a belt or harness worn by an emergency or military personnel.

FIG. 1 illustrates an anchor apparatus 10 embodying features of the present invention in a folded, collapsed, storage condition removed from a protective carrier pouch 12, (FIG. 3). The pouch and apparatus contained therein being secured to a belt 14 or other suitable article of clothing normally worn by a user, for quick access to and removal of the apparatus by the user when needed. The pouch 12 may, although not specifically shown herein, be arranged to also hold a ring type fastener such as a carabeener 16, and a selected rappel line 32 for use with the apparatus as will be explained.

Figure 2:
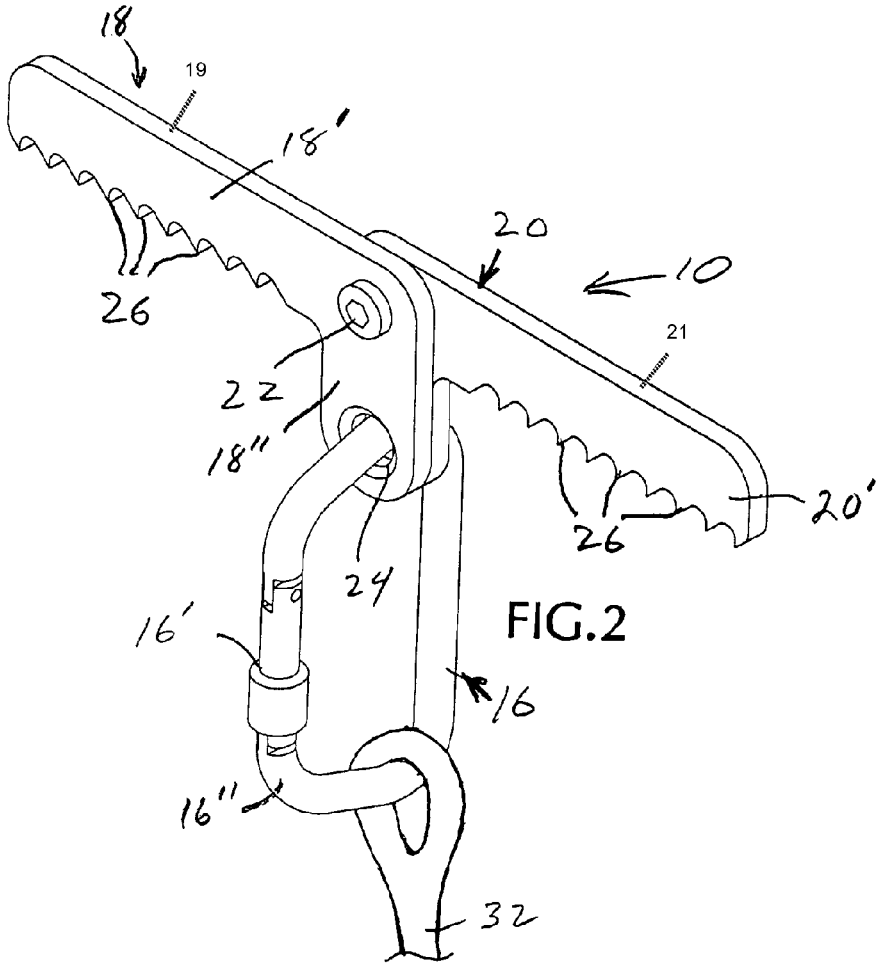
FIG. 2 is a rear perspective view showing the apparatus locked in extended, operative, generally T-shaped condition by engagement of a rappel line-supporting carabeener.

As can be readily seen in viewing FIGS. 1 and 2 of the drawings, the anchor apparatus of this invention comprises a substantially T-shaped, generally flat body formed, in the illustrated embodiment, by a pair of substantially identical, first and second L-shaped jaw members 18, 20 respectively, each member having a bore (not shown) therethrough at the juncture of the long 18', 20' and short 18", 20" legs forming the L-shape. As shown, these bores are arranged, with jaw member 20 positioned in inverted condition and overlying jaw member 18, to align with each other and receive therethrough a mounting pivot member 22 at the juncture of the long and short legs forming the L-shaped jaw members. The pivot member interconnects and positively secures the opposite jaw members 18, 20 together for relative pivotal movement of the jaw members between the collapsed, folded storage condition of FIG. 1 and the extended, operative, T-shaped condition of FIG. 2, wherein the long legs 18', 20' together form the upper, lateral leg forming the top of the T-shape body, and the short legs 18", 20", which extend perpendicularly from the center of one, working edge of the top leg, together form the upright, vertical leg of the T-shape anchor mount body. A metal, Teflon, or other low friction washer (not shown) may be interposed between the jaw members at the location of the pivot member 22 to enhance free pivoting movement of the jaw members and prevent any possibility of binding.

The L-shaped jaw members 18, 20 are preferably formed of metal, such as steel, aluminum or other metal as may be desired, but may also if desired be formed of other suitable strong materials such as high strength composite fiber resin materials if needed. For obvious reasons however, metal is preferred for its strength, durability, high heat tolerance and overall reliability and safety for its intended use as will become apparent later.

The upright leg of the T-shaped body is provided with an attachment bore member for receiving a rappel line-mounting ring-type fastener member. In the embodiment illustrated, each jaw member 18, 20 is provided with an enlarged attachment bore 24 through the short leg 18", 20" of the L-shaped jaw member adjacent the outer terminal end of the respective short leg, as shown. Each attachment bore 24 is arranged and dimensioned to closely, but freely receive a leg portion of a selected ring-type fastener member such as carabeener 16 inserted therethrough. As illustrated in FIG. 2, the bores 24 are positioned through each short leg to come into close alignment with each other when the jaws 18, 20 are pivoted about pivot mount 22 into the extended condition of FIG. 2, in which the short legs of the jaw members are mutually aligned in overlying condition.

With a leg portion of a carabeener or other selected ring-type connector member extending through the aligned bores 24, the respective jaws 18, 20 are effectively locked or secured against substantial relative pivoting movement, with the respective long legs 18', 20' of each L-shaped jaw member extending outwardly in opposite longitudinal directions of extension as shown. In this locked, extended condition, the anchor apparatus 10 forms a generally T-shaped member with the overlying, aligned short legs 18", 20" of the jaw members forming the normally vertical, or upright leg of a T and the axially-extending long legs 18', 20' together forming the lateral, top leg of a T.

With this in mind, it is to be understood that each long leg extends laterally outwardly on a line forming an included angle of no more than 90 degrees relative to a line extending through the aligned short legs. Preferably the long legs extend on lines forming an included angle that is slightly less than 90 degrees in order to better insure positive anchoring of the anchor apparatus in use.

Again with reference to the L-shaped jaw members 18, 20, it can be seen that each long leg includes a plurality of sharp, coarse, pitched claw teeth 26 formed along and projecting outwardly along the length of its edge facing the direction of extension of its short leg. This edge defines the working edge surface of the top leg of the T-shaped body. While the particular size, pitch and shape of the teeth may of course vary as may be determined to be best suited for the purpose in various environments likely to be encountered in different uses, it is to be understood that the teeth are configured to provide a positive, secure frictional biting engagement with an engaged surface to prevent any slipping, sliding or other movement of the apparatus on the supporting engaged surface that may result in disengagement of the apparatus from the surface to which it is abuttingly engaged. Other work surface configurations may alternatively be selected as needed or desired.

Figure 4:
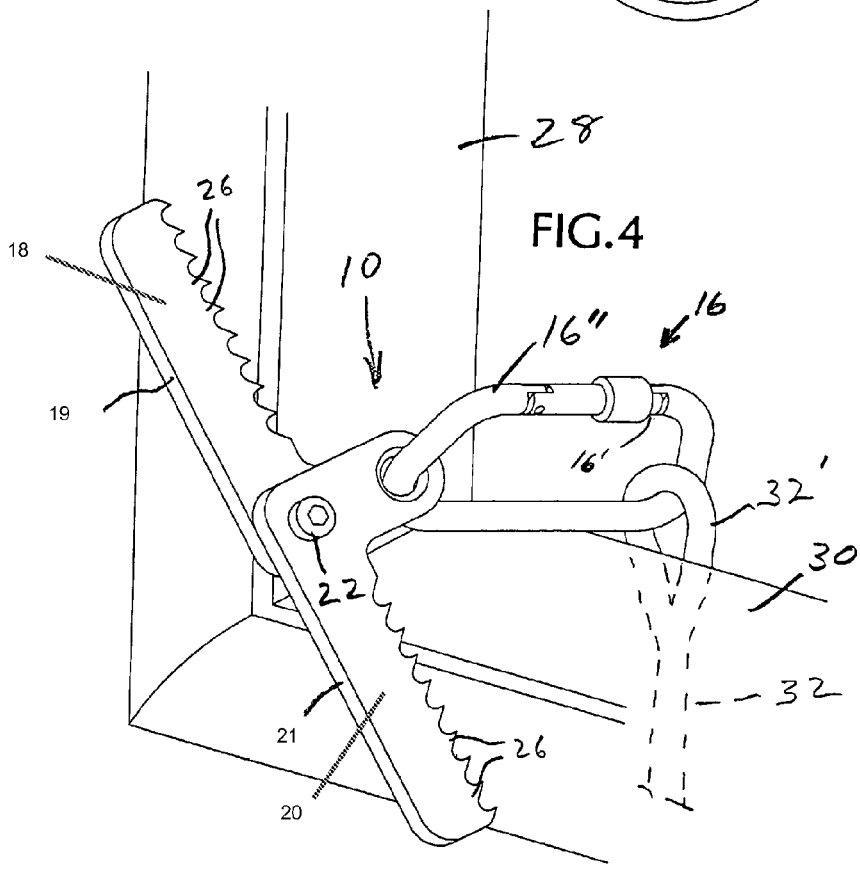
FIG. 4 is a fragmentary perspective view showing the emergency rappel line anchor mount apparatus in a condition of use with a wall opening provided by a window structure of an exterior wall of a building to be evacuated by emergency rappelling.

As best illustrated in FIGS. 2 and 4, each of the L-shaped jaw members 18 and 20 includes a non-working edge 19 and 21, respectively, that are opposite the work surface configurations bearing the teeth 26. When the anchor apparatus 10 is in a folded, collapsed, storage condition as best illustrated in FIGS. 1 and 3 the non-working edges 19 and 21 preferably cooperate to define a boundary. In one embodiment, the teeth 26 of the L-shaped jaw member 18 substantially align with the non-working edge 21 at a position inwardly thereof and the teeth 26 of the L-shaped jaw member 20 substantially align with the non-working edge 19 at a position inwardly thereof, for example, as best illustrated in FIG. 1. In other embodiments, the projecting teeth 26 do not extend beyond the boundary defined by the non-working edges 19 and 21 when the L-shaped jaw members 18 and 20 are in the storage position, for example, as best illustrated in FIG. 3.

An illustrative example of the emergency egress rappel line anchor apparatus of this invention in use is shown in FIG. 4 of the drawings which is believed to be substantially self-explanatory. In this example, an exterior wall of a building includes a window frame, the lower corner portion of which is illustrated by the junction of the side 28 and bottom 30 window jambs of the window frame opening. In the event that a person needs to evacuate himself by rappelling, the user would pull the anchor apparatus 10, carabeener 16 and rappel line from its protective storage pouch 12 and pivot the apparatus from its storage condition of FIG. 1 to its operative position of FIG. 2.

The user then opens the carabeener latch 16' and inserts the leg 16" of the carabeener 16 through the aligned bores 24, thereby locking the anchor apparatus in its operative condition of FIG. 2. The user then attaches a rappel line structure, shown in FIG. 4 as a simple rappel line 32 terminating in a closed loop 32', (if not previously connected), onto the carabeener which then is locked as is known in the art. It is to be understood that although the rappel line is illustrated herein as a simple rope member 32, other forms of rappel lines and rappel line equipment are well known in the art and are intended to be represented by the loop end 32' of a rappel line rope 32 shown here.

The anchor apparatus 10 of the present invention is then positioned as illustrated with the working surface of the working edge of the top leg of the T-shaped body positioned against the wall diagonally bridging the corner section of the window frame jamb structure 28, 30, whereupon the rappel line 32 may be dropped outside the building through the opening bordered by the wall surface and bridged by the apparatus. The evacuee, maintaining a tension on the rappel line to assure against displacement of the apparatus from its mounted condition against the wall, then begins his rappel down the outside of the building.

If time allows, the user, after initially positioning the anchor apparatus diagonally at the jamb structure, may then strike the edges of the jaw members opposite the working edge having the teeth with any suitable object in order to embed the teeth more positively into biting engagement with the surface of the wall and window frame structure for more security against displacement of the anchor apparatus in use. Clearly, once the evacuee is supported on the rappel line, his weight applies continuous force on the anchor structure to assure its maintained, biting engagement with the window jamb structure and against inadvertent displacement therefrom.

As will be apparent to those skilled in the art, any existing structural configuration, other than the corner of a window jamb as illustrated, which permits the teeth to engage with a support surface and allow the center short leg section, carabeener and rappel line to extend outwardly towards the outside of the wall or structure being rappelled, will permit suitable anchoring and operation of the tool of this invention. As an example, in an older building there may be hot water or steam radiators located in a room to be evacuated, and the user may secure the apparatus in operative, extended condition by securement of the ring type fastener, carabeener 16, through the aligned bores 24, the terminal end of the rappel line of course being secured to the carabeener as shown in FIG. 2. The emergency anchor mounting apparatus is then oriented with the extending jaw members 18, 20 disposed in a substantially vertical condition for passage of the apparatus in between the courses of the radiator. The apparatus is then rotated 90.degree, whereupon the jaw members are positively captured behind the radiator structure as will be apparent. Maintaining constant tension on the rappel line, the user then moves to and out of the window or other wall opening and rappels in normal fashion. It will also be readily apparent to those skilled in the art that various changes other than those already described may be made in the size, shape, type, number and arrangement of parts described hereinbefore without departing from the spirit of this invention and the scope of the appended claims.

The invention claimed is:

1. An anchor apparatus for engaging and securing a rappel line comprising:

an L-shaped first jaw member having a longer leg and a shorter leg, wherein the longer leg includes a first working edge and a first non-working edge opposite the first working edge;

an L-shaped second jaw member having a longer leg and a shorter leg, wherein the longer leg includes a second working edge, a second non-working edge opposite the second working edge, and the second jaw member is pivotally connected to the first jaw member in an overlying relationship and pivotable between (1) an operative position in which the first and second working edges face the same direction and the shorter legs of the first and second jaw members are aligned and overlapping, and (2) a storage position in which the first and second working edges face opposite directions and the longer legs of the first and second jaw members are aligned and overlapping;

a first plurality of projecting teeth arranged on the first working edge for frictional, biting engagement with a support surface;

a second plurality of projecting teeth arranged on the second working edge for frictional, biting engagement with a support surface;

wherein, when the first and second jaw members are in the storage position, the first plurality of projecting teeth substantially align with the second non-working edge and the second plurality of projecting teeth substantially align with the first non-working edge;

a first attachment bore through the shorter leg of the first jaw member;

a second attachment bore through the shorter leg of the second jaw member; and wherein the first and second attachment bores align with each other when the first and second jaw members are in the operative position; wherein a rappel line is secured to the anchor apparatus via the first and second attachment bores.

2. The anchor apparatus of claim 1, wherein, when the first and second jaw members are in the storage position, the first plurality of projecting teeth substantially align with the second non-working edge at a position inwardly thereof and the second plurality of projecting teeth substantially align with the first non-working edge at a position inwardly thereof.

3. The anchor apparatus of claim 2, wherein:

the first non-working edge and the second non-working edge define a boundary when the first and second jaw members are in the storage position; and the first and second pluralities of projecting teeth do not extend beyond the boundary defined by the first and second non-working edges when the first and second jaw members are in the storage position.

4. The anchor apparatus of claim 1, wherein the first and second jaw members are substantially identical.

5. The anchor apparatus of claim 1, wherein:

an included angle defined by a first line bisecting the longer leg of the first jaw member and by a second line bisecting the shorter leg of the first jaw member is less than 90°; and an included angle defined by a first line bisecting the longer leg of the second jaw member and by a second line bisecting the shorter leg of the second jaw member is less than 90°.

6. The anchor apparatus of claim 1, wherein: each of the first and second plurality of projecting teeth includes a base proximate the first or second working edge and an edge distal therefrom, wherein each edge is defined by the intersection of a first and second surface that project in a direction away from the first or second working edge.

7. The anchor apparatus of claim 1, wherein the first and second attachment bores include a bore diameter that closely but freely receives a rappel line-mounting fastener therethrough.

8. The anchor apparatus of claim 1 further comprising a ring type fastener configured to pass through the first and second attachment bores to releasably lock the first and second jaw members in the operative position.

9. An anchor apparatus system comprising:

the anchor apparatus of claim 1; and a storage pouch comprising a belt loop and an anchor retaining pocket, wherein the anchor retaining pocket is sized to receive the anchor apparatus in the storage position with the longer legs of the first and second jaw members aligned and overlapping.

10. The anchor apparatus system of claim 9, wherein:

the anchor retaining pocket is sufficiently deep to cover the first and second pluralities of projecting teeth of the longer legs of the first and second jaw members.

* * * * *